US005865480A

United States Patent [19]

Bain, Jr. et al.

[11] Patent Number: 5,865,480

[45] Date of Patent: Feb. 2, 1999

[54] SLIDING DOOR SECURITY AND CHILD SAFETY LATCH

[76] Inventors: Lincoln Grady Bain, Jr., 2017 E. Libra Dr., Tempe, Ariz. 85283; Lincoln Grady Bain, III, 4681 W. Geronimo St., Chandler, Ariz. 85226

[21] Appl. No.: 969,104

[22] Filed: Nov. 13, 1997

Related U.S. Application Data

[63] Continuation of Ser. No. 709,007, Sep. 6, 1996, abandoned.

[51] Int. Cl.[6] ..... E05C 5/00

[52] U.S. Cl. ..... 292/67; 292/109; 292/114; 292/DIG. 65; 292/DIG. 46

[58] Field of Search ..... 292/67, 63, 128, 292/DIG. 46, 150, 192, 228, 121, 271, 277, 269, 109, 114, DIG. 63, DIG. 65; 70/93

[56] References Cited

U.S. PATENT DOCUMENTS

| | | | |
|---|---|---|---|
| 281,174 | 7/1883 | Briggs et al. | 292/DIG. 46 X |
| 305,294 | 9/1884 | Corn | 292/150 |
| 497,813 | 5/1893 | Pease | 292/198 |
| 917,969 | 4/1909 | Shinn | 292/DIG. 46 X |
| 953,662 | 3/1910 | Hanson | 292/273 |
| 983,647 | 2/1911 | Romines | 292/DIG. 46 X |
| 1,016,422 | 1/1912 | Lauritsen . | |
| 1,067,133 | 7/1913 | Peters . | |
| 1,075,367 | 10/1913 | Merritt . | |
| 1,082,638 | 12/1913 | Karger . | |
| 1,128,502 | 2/1915 | Pinnow | 29/DIG. 46 X |
| 1,183,833 | 5/1916 | Klohs | 292/DIG. 46 X |
| 1,408,240 | 2/1922 | Allstatter . | |
| 1,459,812 | 6/1923 | Zeman | 292/DIG. 46 X |
| 1,639,878 | 8/1927 | Bentrott | 292/DIG. 46 X |
| 1,807,911 | 6/1931 | Garbell . | |
| 2,723,148 | 11/1955 | Johnson, Jr. | 292/DIG. 46 X |
| 2,784,019 | 3/1957 | Des Combes | 292/DIG. 46 X |
| 3,103,713 | 9/1963 | Ahlgren . | |
| 3,405,961 | 10/1968 | Sanders | 292/207 |
| 3,479,769 | 11/1969 | Diack | 49/449 |
| 3,554,592 | 1/1971 | Katz | 292/263 |
| 3,667,793 | 6/1972 | Varrin et al. | 292/216 |
| 4,017,105 | 4/1977 | Paxton | 292/251 |
| 4,109,949 | 8/1978 | Smith | 292/DIG. 46 X |
| 4,198,084 | 4/1980 | Trotta | 292/209 |
| 4,214,783 | 7/1980 | Boegeman | 292/150 |
| 4,492,396 | 1/1985 | Luke et al. | 292/228 |
| 4,715,629 | 12/1987 | Robinson | 292/256 |
| 4,763,933 | 8/1988 | Guardia | 292/13 |
| 4,765,662 | 8/1988 | Suska | 292/92 |
| 4,776,619 | 10/1988 | Daugherty et al. | 292/201 |
| 4,974,887 | 12/1990 | Pucci | 292/228 |
| 5,052,731 | 10/1991 | Hayakawa et al. | 292/336.3 |
| 5,114,194 | 5/1992 | Toifl et al. | 292/106 |
| 5,452,927 | 9/1995 | Uyeda | 292/202 |

FOREIGN PATENT DOCUMENTS

| | | | |
|---|---|---|---|
| 10236 | 5/1893 | United Kingdom | 292/63 |
| 364731 | 1/1932 | United Kingdom | 292/162 |

*Primary Examiner*—Darnell M. Boucher
*Attorney, Agent, or Firm*—Schmeiser, Olsen & Watts

[57] ABSTRACT

A latch for maintaining a sliding door in one of several modes such as a child-safety mode. When in the child-safety mode, the range of motion of the sliding door is restricted, however, the latch may be disengaged by an adult from either side of the sliding door. The latch may also be employed in a security mode to prevent any opening of the sliding door from the exterior side. The latch may additionally be employed in a ventilation mode wherein the sliding door is slightly opened with overriding of the latch available only from the interior of the sliding door.

9 Claims, 2 Drawing Sheets

SLIDING DOOR SECURITY AND CHILD SAFETY LATCH

This application is a continuation of application No. 08/709,007 filed Sep. 6, 1996, now abandoned.

FIELD OF THE INVENTION

The present invention relates generally to the field of latching devices and, more particularly, to the field of child-safety and security latches for sliding doors.

BACKGROUND OF THE INVENTION

Sliding doors typically have been designed for installation in areas where hinged swinging doors may not practically operate or where large rolling panes of glass are aesthetically desirable. Sliding doors have become increasingly popular for partitioning adjacent rooms or for serving as exterior doors to the outdoors.

Access to areas partitioned by doors has historically been controlled by latches or locks, and alternatively, by judgment and common-sense. When a partitioned area contains a hazard or danger, a latch or lock may secure the door against intrusion. For example, a latch may be used to prevent a child's access to a pool area. For convenience, latches and locks have been traditionally located midway between the top and bottom of a standard door. Such a placement of a latch accommodates individual users having varying heights. However, such low placement of latches enables smaller children to also activate the latch and pass through the door. Furthermore, some doors, and in particular sliding and bar doors, are not necessarily latched when in a closed but unlocked positions and may be opened or retracted merely by applying pressure to any surface of the door and pushing or sliding. Thus, their effectiveness is preventing children from passing through the door may be limited.

Because of the unappreciated and unknown dangers beyond a door that await small children, devices for limiting access by children have been developed and are known in the art. Commonly known devices such as striker hooks for cabinet doors, free-spinning door knob covers, and security chains mounted out of reach have been developed for use in child-proofing hinged swinging doors. However, child-proof access limiting devices for sliding doors are virtually unknown and non-existent. Furthermore, many child-proof access limiting devices may become a nuisance for adults to operate because of the additional access limitations they overlay on adult users. When such devices become obstructive to adults, such devices are frequently disengaged or bypassed thus minimizing their beneficial use. For example, a security chain when placed on the interior of a sliding door and engaged, may limit the travel of the sliding door when a child attempts to open it. Even as the slack in the chain is taken up by the opening of the sliding door, the door remains child-proof as the opening is insufficient for a child to pass through. However, the engaged safety chain on the interior of the sliding door prohibits an adult user of the sliding door from entering from the exterior side. Other access limiting devices, such as stops that restrict door travel, that are only overrideable from one side of the door equally become a nuisance to adult users. Furthermore, these types of safety chains must be positively locked to function and this provide limited protection compared to systems that lock automatically when the door closes.

SUMMARY OF THE INVENTION

Accordingly, it is an advantage of the present invention that an improved child-safety latch for limiting the travel or range of motion of a sliding door is provided.

Another advantage is that the present invention self-engages when the sliding door is closed.

Another advantage is that the present invention may be released, or disengaged by an adult from either side of the sliding door.

Another advantage is that the present invention also may be restricted to a secure position and prevent any opening of the sliding door from the exterior of the sliding door.

Another advantage is that the present invention may be restricted to a ventilation position and allow a slight opening of the sliding door, but prevent the latch from being overridden from the exterior of the sliding door.

The above and other advantages of the present invention are carried out in one form in a latch for maintaining a sliding door that includes a base that can be mounted on the door or door frame, and a latch member that is slidably and pivotally attached to the base. The latch limits the travel of the sliding door, either keeping the door completely shut or allowing it to partially open before engaging, depending upon the mode of operation. When in child safety mode, the door can open partially and an adult can release the child-safety latch from either side of the sliding door. When in security mode, the door cannot be opened at all from the exterior side of the door.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE DRAWINGS

Figure 1:
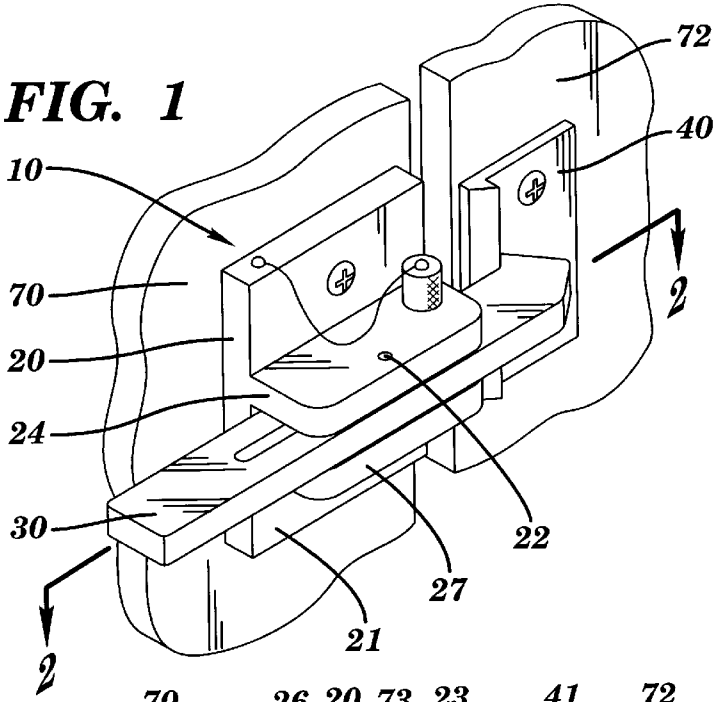
FIG. 1 is a perspective view of the preferred embodiment of the latch in the security mode.
Figure 2:
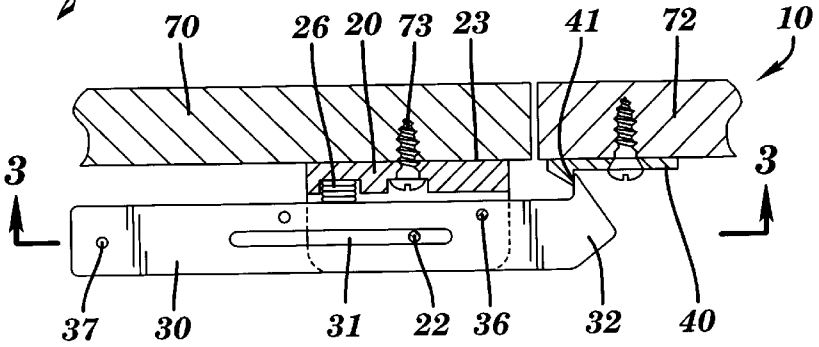
FIG. 2 is a cross sectional top view of the preferred embodiment of the latch in the security mode taken along lines 2—2 of FIG. 1.
Figure 3:
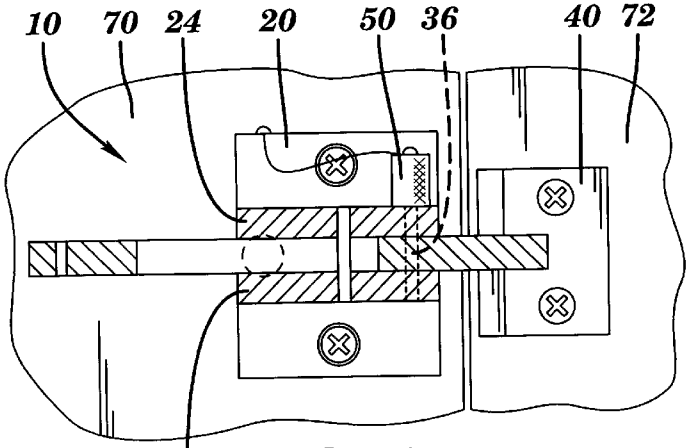
FIG 3 is a cross-sectional side view of the preferred embodiment of the latch in the security mode taken along lines 3—3 of FIG. 2.
Figure 4:
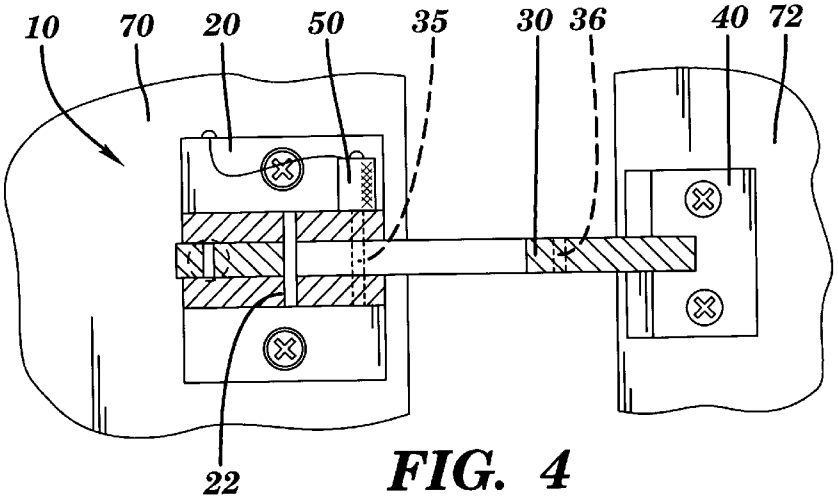
FIG. 4 is a view of the preferred embodiment of the latch in the ventilation mode.
Figure 5:
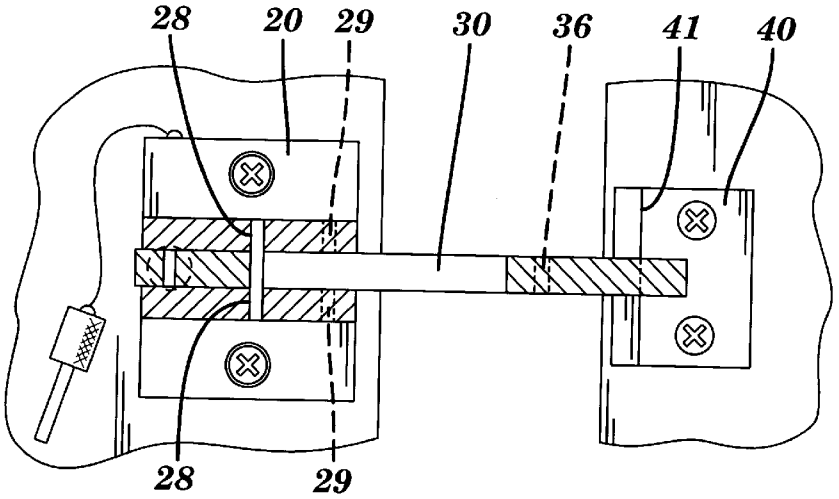
FIG. 5 is a view of the preferred embodiment of the latch in the child-safety mode.
Figure 7:
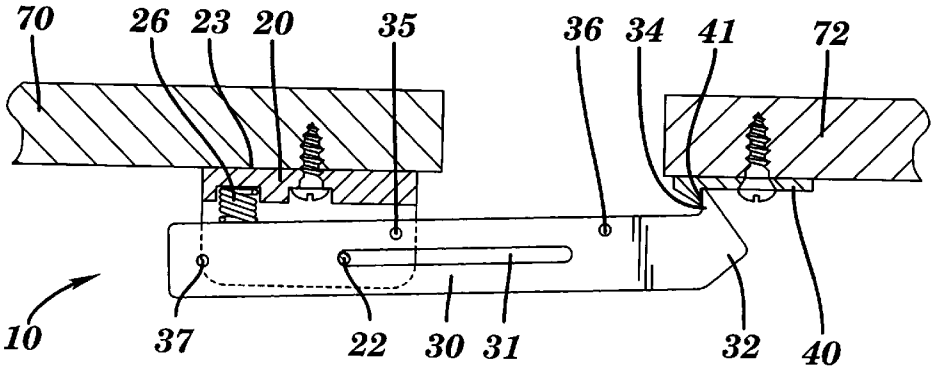
FIG. 7 is a cross-sectional top view of the preferred embodiment of the latch in the child-safety mode taken along lines 7—7 of FIG. 6.
Figure 6:
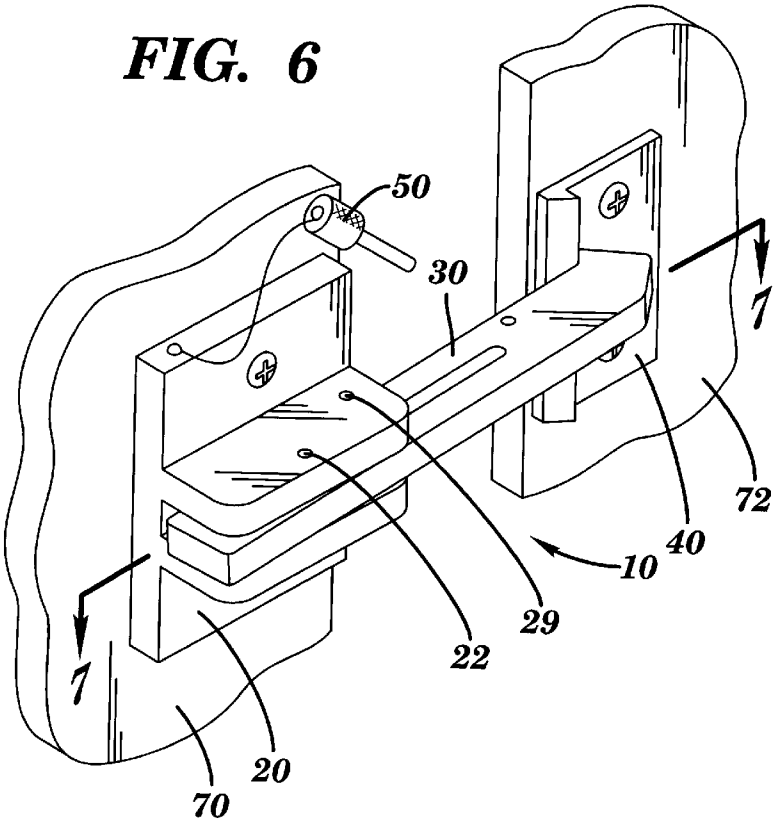
FIG. 6 is a perspective view of the preferred embodiment of the latch in the child-safety mode.

Referring to FIGS. 1–7 generally, a latch 10 is illustrated in accordance with the preferred embodiment for maintaining a sliding door that operates in two modes: a security mode and a child-safety mode. Additionally, a third mode, a ventilation mode can be provided if desired. The major components of latch 10 include a base 20, a latch member 30, and a catch plate 40. Latch member 30 is mounted to base 20 such that it can both slide and pivot relative to base 20. When latch 10 is in a security mode, latch member 30 engages catch plate 40 and locks the door shut, as illustrated in FIGS. 1–3. When the latch 10 is in child-safety mode, the latch member 30 slides and allows the door to partially open before it engages catch plate 40 and prevents it from opening further, as illustrated in FIGS. 5–7. With the door partially open, an adult can easily open the door from the outside by pushing the latch member 30 through the door opening such that latch member 30 pivots past catch plate 40, but a child unable that is unable to reach latch member 30 cannot open the door. Thus, in child-safety mode adults can enter and exit without inconvenience while children who cannot reach the latch 10 cannot.

An additional mode, a ventilation mode, can be facilitated that allows the door to partially open, as in child safety mode, but the latch member 30 cannot be pivoted past catch plate 40 from the exterior side of the door, as illustrated in FIG. 4. This allows the door to be held partially opened, yet secured from unwanted entry.

In addition to base 20, latch member 30 and catch plate 40, latch 10 preferably comprises a biasing mechanism 26, a retainer pin 22 and a lock pin 50.

Base 20 facilitates the mounting of latch 10 on the interior of a sliding door unit. The sliding door unit includes a sliding door 70 mounted in a sliding door frame 72. Latch 10 may be mounted in either direction, with the base 20 mounted on either the sliding door frame 72 or sliding door 70. FIGS. 1–7 illustrate the base 20 mounted on the sliding door 70, but base 20 may alternatively be mounted on a door frame 72 with the latch reversed from that shown in FIGS. 1–7.

Base 20 is comprised of both a bottom surface 23 for planer mounting to a surface such as sliding door 70 and a top surface 21. Base 20 affixes to sliding door 70, in the preferred embodiment, with fasteners 73 passing therethrough. In an alternate embodiment, base 20 may be integral with sliding door 70.

Top surface 21 of base 20 provides a foundation for orthogonally oriented opposing flanges 24 and 27. Opposing flanges 24 and 27 are generally planer having sufficient thickness for supportive strength in extending from top surface 21 of base 20. Opposing flanges 24 and 27, in the preferred embodiment, are integral to base 20 and form a slide channel to support and guide latch member 30. Nothing, however, prevents opposing flanges 24 and 27 form being orthogonally affixed to base 20 by the use of fasteners through apertures on both base 20 and opposing flanges 24 and 27.

Opposing flanges 24 and 27 each have a retainer aperture 28 for receiving retainer pin 22 subsequent to the placement of latch member 30 in the slide channel formed by opposing flanges 24 and 27. Opposing flanges 24 and 27 preferably each have a lock pin aperture 29 for receiving lock pin 50.

Latch member 30 operably spans between sliding door 70 and door frame 72 to provide a fixed orientation between sliding door 70 and door frame 72 in either a security, ventilation, or child-safety mode. Latch member 30 preferably is an elongated planer member fabricated from a material capable of restraining the motional force of a sliding door, such as machined aluminum.

Latch member 30 preferably has a streamlined catching end 32 with a lip 34 for engaging with catch plate 40 secured to door frame 72. Catching end 32, prior to engagement with catch plate 40, glides along a streamlined surface of catch plate 40 until lip 34 of catching end 32 engages with lip 41 of catch plate 40. Biasing mechanism 26, preferably a spring 26 expansively biases latch member 30 such that catching end 32 engages or captures catch plate 40. Spring 26, located between opposing flanges 24 and 27, exerts expansive force on latch member 30 and is retained by a socket formed from retention grooves extending longitudinally with spring 26 on the inner faces of opposing flanges 24 and 27. Spring 26 may alternatively be retained by a spring retainer pin through its center and affixed erect from base 20.

Latch member 30 has an elongated slot 31 along the longitudinal axis for guiding the travel of latch member 30 in the slide channel formed by flanges 24 and 27. With retainer pin 22 inserted through elongated slot 31 and aperture 28 of flanges 24 and 27, latch member 30 may pivot and slidably travel in the longitudinal direction with the retainer pin 22 serving as a fulcrum and guide. Thus, the longitudinal travel of latch member 30 is restricted only by retainer pin 22 encountering the longitudinal boundaries of elongated slot 31.

Latch member 30 preferably has a security aperture 36 for restricting movement of latch member 30 to a security mode position when lock pin 50 is received through aligned lock pin aperture 29 and security aperture 36. When lock pin 50 is inserted in lock pin aperture 29 and security aperture 36, the latch member 30 is maintained in the mode illustrated in FIGS. 1–3 and the door is held shut. In particular, the lock pin 50 prevents the latch member 30 from either sliding out, which would allow the door to partially open, or pivoting, which would allow the catch plate to 40 move past latch member 30. Thus, with the lock pin 50 inserted into the security aperture 36, the latch 10 operates similarly to a conventional door look, keeping the door locked shut and preventing the door being opened from the outside.

When the lock pin 50 is removed, latch member 30 can slide and pivot relative to base 30. In this configuration, illustrated in FIGS. 5–7, latch 10 operates as a child-safety lock. In particular, when the door shuts, spring 26 biases catching end 32 of latch 30 toward catch plate 40, latching the door shut. The door can then be partially opened until the sliding movement of latch 30 is stopped by retainer pin 22 encountering the edge of elongated slot 31. Latch 30 is preferably configured such that the door is allowed to open enough that latch member 30 can be pushed from the exterior side of the door through the opening to disengage from catch plate 40, but not so much as to allow a child to pass through the opening. At this point an adult can open the door from either side by pivoting latch member 30 away from catch plate 40 such that the door can pass by. This allows adults to pass through the door in both directions with limited inconvenience. As long as the latch 10 is mounted high enough on the door children are prevented from opening the door. Furthermore, when the door is shut again, the latch member 30 automatically re-engages catch plate 40. Thus, the door is automatically locked, helping to insure that children cannot pass at all times.

Latch member 30 may also comprises a ventilation aperture 35 if desired. Ventilation aperture 35 restricts movement of latch member 30 to a ventilation mode position when lock pin 50 is received through aligned lock pin aperture 29 and ventilation aperture 35. This mode of operation is illustrated in FIG. 4. In this mode the door can be opened slightly, but the pin prevents latch member 30 from pivoting and moving past the catch plate 40. Thus, the door can be opened slightly but cannot be completely opened from the outside of the door.

Latch member 30 optionally has a lock pin storage aperture 37 for stowage of lock pin 50 when latch 10 is engaged in child-safety mode.

As previously mentioned, retainer pin 22 secures latch member 30 within the slide channel formed by opposing flanges 24 and 27 by providing a stop as latch member 30 travels between a security mode position (FIGS. 1–3) and a slightly open position used in child-safety mode (FIGS. 5–7) and ventilation mode (FIG. 4). Retainer pin 22 also functions as a fulcrum for latch member 30 allowing latch member 30 to pivot between and slidably travel between opposing flanges 24 and 27. Retainer pin 22 preferably assumes the form of a press pin or rivet, or alternatively may be comprised of a treaded member such as a screw and a retaining member such as a threaded nut.

Catch plate 40 operatively captures and restricts the travel of catching end 32 of latch member 30 relative to door frame 72. Catch plate 40 is generally planer with a streamlined leading edge forming lip 41. In the preferred embodiment, catch plate 40 affixes to the interior of door frame 72 with fasteners 74 passing therethrough. For situations where the door or door frame has a suitable lip for engaging latch 30, catch plate 40 can be dispensed with altogether.

In summary, the preferred embodiment provides an improved apparatus for maintaining a sliding door that operates in two distinct modes: a security mode and a child-safety mode. The preferred embodiment invention implements the child-safety mode by allowing an adult to release or disengage the latch from either side of the sliding door. The preferred embodiment also provides a latch capable of being engaged in a security mode preventing the opening of the sliding door from the exterior of the sliding door.

The present invention has been described above with reference to preferred embodiments. However, those skilled in the art will recognize that changes and modifications may be made in these preferred embodiments without departing from the scope of the present invention. Various modifications of the disclosed embodiments, as well as alternative embodiments of the invention will become apparent to persons skilled in the art upon reference to the description of the invention. It is, therefore, contemplated that the appended claims will cover such modification that fall within the scope of the invention.

We claim:

1. A latch for maintaining a sliding door in a position relative to a door frame in a door unit, wherein said door unit comprises a first member and a second member, said latch comprising:

(a) a base for mounting on said first member of said door unit, said base comprising first and second opposing flanges forming a slide channel;

(b) a latch member, said latch member including a catching end for catching said second member, said latch member slidably and pivotally coupled in said slide channel, wherein said latch member is slidably coupled such that said latch member can slide from a first position to a second position, such that said sliding door can be partially opened before said catching end engages said second member and prevents said sliding door from opening further and wherein said latch member can be pivoted by a user from either side of the door such that said catching end disengages from said second member, allowing said sliding door to completely open, wherein said latch member includes a first aperture and an elongated slot through said latch member;

(c) a lock pin wherein said latch member is maintained in said first position when said lock pin is engaged through said base and into said first aperture in said latch member;

(d) a retainer pin extending parallel to said first member of said door unit between said first and second opposing flanges and passing through said elongated slot, said retainer pin providing a fulcrum for said latch member to pivot perpendicular to said first member of said door unit and travel stops for said latch member;

(e) a biasing mechanism, said biasing mechanism biasing said catching end of said latch member towards said second member to facilitate engagement with said second member; and (f) wherein said sliding door can be maintained by said catching end in a closed position relative to said door frame when said latch member is in said first position and wherein said sliding door is prevented by said catching end from opening further than a partially open position relative to said door frame when said latch member is in said second position.

2. The latch of claim 1 wherein said latch member further comprises a second aperture wherein said latch member is maintained in said second position and wherein said catch end is prevented from pivoting away from said second member when said lock pin is engaged through said base and into said second aperture.

3. The latch of claim 1 wherein said first member comprises the door frame and wherein said second member comprises the sliding door.

4. The latch of claim 1 wherein said second member comprises the door frame and wherein said first member comprises the sliding door.

5. The latch of claim 1 further comprising a catch plate mounted to said second member, wherein said catch plate comprises a lip for engaging said catching end of said latch member.

6. The latch of claim 1 wherein said biasing mechanism comprises a spring between said base and said latching member and wherein said first and second opposing flanges each have opposing spring retention grooves for retaining said spring.

7. A child safety latch for maintaining a sliding door in a position relative to a door frame in a door unit, wherein said door unit comprises a first member and a second member, said latch comprising:

(a) a base for mounting on said first member of said door unit, said base comprising first and second opposing flanges forming a slide channel;

(b) a latch member slidably and pivotally coupled in said slide channel, wherein said latch member is slidably coupled such that said latch member can slide from a first position to a second position, wherein said latch member includes a first aperture, a second aperture, and an elongated slot through said latch member, and further includes a catching end for catching said second member to restrict travel of said sliding door;

(c) a lock pin, wherein said latch member is maintained in said first position when said lock pin is engaged through said base and into said first aperture and wherein said latch member is maintained in said second position and wherein said catch end is prevented from pivoting away from said second member with said lock pin is engaged through said base and into said second aperture;

(d) a retainer pin extending parallel to said first member of said door unit between said first and second opposing flanges and passing through said elongated slot, said retainer pin providing a fulcrum for said latch member to pivot perpendicular to said first member of said door unit and travel stops for said latch member;

(e) a spring, said spring biasing said catching end of said latch member towards said second member to facilitate engagement with said second member, and wherein said first and second opposing flanges each have opposing spring retention grooves for retaining said spring; and (f) wherein said sliding door can be maintained by said catching end in a closed position relative to said door frame when said latch member is in said first position and wherein said sliding door is prevented by said catching end from opening further than a partially open position relative to said door frame when said latch member is in said second position, and wherein said partially open position allows an adult to release said latch from either side of said sliding door when said lock pin is not engaged through said second aperture into said latch member.

8. The latch of claim 7 wherein said first member comprises the door frame and wherein said second member comprises the sliding door.

9. The latch of claim 7 wherein said second member comprises the door frame and wherein said first member comprises the sliding door.

* * * * *